US007985332B2

(12) United States Patent
Greaney et al.

(10) Patent No.: US 7,985,332 B2
(45) Date of Patent: Jul. 26, 2011

(54) ELECTRODESULFURIZATION OF HEAVY OILS USING A DIVIDED ELECTROCHEMICAL CELL

(75) Inventors: Mark A. Greaney, Upper Black Eddy, PA (US); Kun Wang, Bridgewater, NJ (US); James R. Bielenberg, Easton, PA (US); Douglas W. Hissong, Cypress, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 338 days.

(21) Appl. No.: 12/288,567

(22) Filed: Oct. 21, 2008

(65) Prior Publication Data

US 2009/0159501 A1 Jun. 25, 2009

Related U.S. Application Data

(60) Provisional application No. 61/008,416, filed on Dec. 20, 2007.

(51) Int. Cl.
*C10G 45/02* (2006.01)

(52) U.S. Cl. ..... 208/212; 205/696

(58) Field of Classification Search ..... 205/696; 208/212

See application file for complete search history.

(56) References Cited

U.S. PATENT DOCUMENTS

| | | | |
|---|---|---|---|
| 1,642,624 | A | 9/1927 | Northrup |
| 1,998,849 | A | 4/1935 | Schulze |
| 2,504,058 | A | 4/1950 | Unschuld et al. |
| 3,409,520 | A | 11/1968 | Bolmer |
| 3,546,105 | A | 12/1970 | Jaffe |
| 3,788,978 | A | 1/1974 | Bearden, Jr. et al. |
| 3,915,819 | A | 10/1975 | Bell et al. |
| 4,043,881 | A | 8/1977 | Yen et al. |
| 4,043,885 | A | 8/1977 | Yen et al. |
| 4,045,313 | A | 8/1977 | Yen et al. |
| 4,066,739 | A | 1/1978 | Chen |
| 4,081,337 | A | 3/1978 | Spitzer |
| 4,204,923 | A | 5/1980 | Carpenter |
| 4,260,394 | A | 4/1981 | Rich |
| 4,362,610 | A | 12/1982 | Carpenter |
| 4,371,307 | A | 2/1983 | Farha, Jr. et al. |
| 4,849,094 | A | 7/1989 | Shmeleva et al. |
| 4,920,015 | A | 4/1990 | Sammells |
| 4,954,229 | A | 9/1990 | Kim et al. |
| 5,391,278 | A | 2/1995 | Honna et al. |
| 5,514,252 | A | 5/1996 | Kerby, Jr. et al. |
| 5,578,189 | A | 11/1996 | Joshi |
| 5,879,529 | A | 3/1999 | Greaney et al. |
| 5,935,421 | A | 8/1999 | Brons et al. |
| 6,132,590 | A | 10/2000 | Moran et al. |
| 6,238,530 | B1 | 5/2001 | Yoshida et al. |
| 6,241,871 | B1 | 6/2001 | Donini et al. |
| 6,274,026 | B1 | 8/2001 | Schucker et al. |
| 6,338,788 | B1 | 1/2002 | Schucker |
| 6,368,495 | B1 | 4/2002 | Kocal et al. |
| 6,402,940 | B1 | 6/2002 | Rappas |
| 6,497,973 | B1 | 12/2002 | Amendola |
| 6,877,556 | B2 | 4/2005 | Wittle et al. |
| 7,244,351 | B2 | 7/2007 | Baez et al. |
| 2003/0102123 | A1 | 6/2003 | Wittle et al. |
| 2005/0161217 | A1 | 7/2005 | Wittle et al. |
| 2006/0102523 | A1 | 5/2006 | Baez et al. |
| 2006/0254930 | A1 | 11/2006 | Martinie et al. |
| 2007/0108101 | A1 | 5/2007 | Baez et al. |
| 2007/0175798 | A1 | 8/2007 | Fokema et al. |

FOREIGN PATENT DOCUMENTS

| | | | |
|---|---|---|---|
| CN | 1699519 | A | 5/2004 |

OTHER PUBLICATIONS

A. M. Aitani, M. F. Ali, H. H. Al-ALI; "A Review of non-conventional methods for the desulfurization of residual fuel oil," Petroleum Science and Technology, 18(5&6), 537-553 (2000).

Cesar Ovalles, Iraima Rojas, Socrates Acevedo, Gaston Escobar, Gilberto Jorge, Luis B. Gutierrez, Alfredo Rincon, Benjamin Scharifker; "Upgrading of Orinoco Belt crude oil and its fractions by an electrochemical system in the presence of protonating agents," Fuel Processing Technology 48 (1996) 159-172.

N. Ignat'Ev et al., New Ionic Liquids with Tris(Perfluoroalkyl)Trifluorophosphate (FAP) Anions, 126 J. Fluorine Chem., 1150-1159 (2005).

*Primary Examiner* — Randy Boyer
(74) *Attorney, Agent, or Firm* — Bruce M. Bordelon

(57) ABSTRACT

The electrodesulfurization of heavy oil feedstreams is accomplished wherein a heavy oil feedstreams, along with hydrogen, is passed the cathode side of an electrochemical cell wherein the organically bound sulfur compounds in the heavy oil are reduced and the sulfur is released as hydrogen sulfide. The hydrogen sulfide can be fed directly into the anode side of the electrochemical cell to produce sulfur and hydrogen or it can be passed to an oxidation zone containing an aqueous solution of an oxidized metal salt.

25 Claims, 4 Drawing Sheets

ELECTRODESULFURIZATION OF HEAVY OILS USING A DIVIDED ELECTROCHEMICAL CELL

This Application claims the benefit of U.S. Provisional Application No. 61/008,416 filed Dec. 20, 2007.

FIELD OF THE INVENTION

This invention relates to the electrodesulfurization of heavy oil feedstreams. The heavy oil feedstreams, along with hydrogen, is passed the cathode side of an electrochemical cell wherein the organically bound sulfur compounds in the heavy oil are reduced and the sulfur is released as hydrogen sulfide. The hydrogen sulfide can be fed directly into the anode side of the electrochemical cell to produce sulfur and hydrogen or it can be passed to an oxidation zone containing an aqueous solution of an oxidized metal salt.

BACKGROUND OF THE INVENTION

Bitumen, in this case, refers to the naturally occurring heavy oil deposits such as the Canadian bitumens found in Cold Lake and Athabasca. Bitumen is a very complex mixture of chemicals and typically contains hydrocarbons, heteroatoms, metals and carbon chains in excess of 2,000 carbon atoms. A variety of technologies are used to upgrade heavy oils, including bitumens. Such technologies include thermal conversion, or coking, that involves using heat to break the long heavy hydrocarbon molecules. Thermal conversion includes such processes as delayed coking and fluid coking. Delayed coking is a process wherein a heavy oil stream is heated to about 932° F. (500° C.) then pumped into one side of a double-sided coker where it cracks into various products ranging from solid coke to vapor products. Fluid coking is similar to delayed coking except it is a continuous process. In fluid coking, the heavy oil stream is heated to about 932° F. (500° C.), but instead of pumping the heavy oil to a coker it is sprayed in a fine mist around the entire height and circumference of the coker. The heavy oil cracks into a vapor and the resulting coke is in the form of a powder-like form, which can be drained from the bottom of the coker.

Another technology used to upgrade heavy oils is catalytic conversion which is used to crack larger molecules into smaller, refineable hydrocarbons in the presence of a cracking catalyst. High-pressure hydrogen is often used in catalytic conversion. While catalytic conversion is more expensive than thermal conversion, it produces a higher yield of upgraded value product.

Distillation is also used for upgrading heavy oils including bitumens wherein the heavy oil is distilled in a distillation tower into a variety of products that boil at different temperatures. The lightest hydrocarbons with the lowest boiling points travel as a vapor to the top of the tower. Heavier and denser hydrocarbons with higher boiling points collect as liquids lower in the tower.

While the above mentioned technologies are useful for converting a portion of heavy oils to lighter and more valuable products, such technologies are not particularly useful for reducing the sulfur content of such feedstocks. One important technology that has been used to reduce the sulfur content (as well as nitrogen and trace metal content) from such feedstocks is hydrotreating. In hydrotreating, or hydrodesulfurization, the heavy oil is contacted with hydrogen and a suitable desulfurization catalyst at elevated pressures and temperatures. The process typically requires the use of hydrogen pressures ranging preferably from about 700 to about 2,500 psig and temperatures ranging from about 650° F. (343° C.) to about 800° F. (426° C.), depending on the nature of the feedstock to be desulfurized and the amount of sulfur required to be removed.

Hydrotreating is efficient in the case of distillate oil feedstocks but less efficient when used with heavier feedstocks such as bitumens and residua. This is due to several factors. First, most of the sulfur in such feedstocks is contained in high molecular weight molecules, and it is difficult for them to diffuse through the catalyst pores to the catalyst surface. Furthermore, once at the surface, it is difficult for the sulfur atoms contained in these high molecular weight molecules to sufficiently contact the catalyst surface. Additionally, such feedstocks may contain large amounts of asphaltenes that tend to form coke deposits on the catalyst surface under the process conditions, thereby leading to deactivation of the catalyst. Moreover, high boiling organometallic compounds present in such oil feedstocks decompose and deposit metals on the catalyst surface thereby diminishing the catalyst life time. Severe operating conditions cause appreciable cracking of high boiling oils thereby producing olefinic fragments which, themselves, consume hydrogen, thereby lowering the process efficiency and increasing costs.

Alternate desulfurization processes that have been employed in the past utilizing alkali metal dispersions, such as sodium, as desulfurization agents. One example of such a process involves contacting a hydrocarbon fraction with a sodium dispersion. The sodium reacts with the sulfur to form dispersed sodium sulfide ($Na_2S$). However, such a process has not proven to be attractive, particularly for treatment of high boiling, high sulfur content feedstocks due to: (a) the high cost of sodium, (b) problems related to removal of sodium sulfide formed in the process, (c) the impracticability of regenerating sodium from the sodium sulfide, (d) the relatively low desulfurization efficiency due, in part, to the formation, of substantial amounts of organo-sodium salts, (e) a tendency to form increased concentrations of high molecular weight polymeric components (asphaltenes), and (f) the failure to adequately remove metal contaminants (iron, nickel, vanadium) from the feed as is observed in the competitive catalytic hydrodesulfurization process.

While various attempts have been made to mitigate some of the above-mentioned problems, low desulfurization efficiency has still remained an unsolved problem. It has been speculated that the low efficiency is due in part to the formation of organo-sodium compounds formed either by reaction of the sodium with acidic hydrocarbons, addition of sodium to certain reactive olefins or as products obtained when sodium cleaves certain of the organic ethers, sulfides and amines contained in the oil. Formation of these organo-sodium compounds, which are desulfurization inactive materials, effectively removes a portion of the sodium that otherwise would be available for the desulfurization reaction. Sodium in excess of the theoretical amount for desulfurization must therefore be added to compensate for organo-sodium compound formation. Moreover, a hydrocarbon insoluble sludge which forms in the course of the sodium-treating reaction (apparently comprised primarily of organo-sodium compounds), makes the reaction mixture extremely viscous and hence impairs mixing and heat transfer performance in the reactor.

Some work has been done to develop electrochemical processes to desulfurize crudes and heavy oils, such as bitumen. Electrochemical processes, such as that taught in U.S. Pat. No. 6,877,556 require the use of reagents such as solvents, electrolytes, or both. Use of such expensive reagents adds to the complexity of those processes since their recovery from the bitumen is required for economic reasons such processes are not commercially practiced.

Therefore, there remains a need in the art for improved process technology-capable of effectively and economically removing sulfur from heavy petroleum feedstock.

SUMMARY OF THE INVENTION

In accordance with a preferred embodiment of the present invention there is provided a process for removing sulfur from heavy oil feedstreams containing sulfur-containing molecules, which process comprises:

a) heating and pressurizing said heavy oil feedstream to a temperature of about 400° F. (204° C.) to about 800° F. (426° C.) and a pressure of about 200 psig to about 700 psig;

b) passing said heated and pressurized heavy oil feedstream and an effective amount of a hydrogen source to the cathode side of a desulfurization electrochemical cell containing at least one cathode side and at least one anode side separated by an ion-permeable membrane and subjecting the heavy oil feedstream to a voltage in the range of about 4V to about 500V and a current density of about 10 mA/cm$^2$ to about 1000 mA/cm$^2$, thereby reducing at least a portion of the sulfur-containing molecules to hydrogen sulfide and resulting in a sulfur-lean heavy oil feedstream and hydrogen sulfide;

c) separating said hydrogen sulfide from said sulfur-lean heavy oil feedstream in a gas/liquid separation zone; and d) introducing at least a portion of said hydrogen sulfide into the anode side of said desulfurization electrochemical cell wherein it is oxidized to produce elemental sulfur and hydrogen ions, and at least a portion of the hydrogen ions migrate to the cathode side of said desulfurization electrochemical cell.

Also in accordance with the present invention there is provided a process for removing sulfur from heavy oil feedstreams containing sulfur-containing molecules, which process comprises:

a) heating and pressurizing said heavy oil feedstream to a temperature of about 400° F. (204° C.) to about 800° F. (426° C.) and a pressure of about 200 psig to about 700 psig;

b) passing the heated and pressurized heavy oil feedstream and an effective amount of a hydrogen source to the cathode side of a desulfurization electrochemical cell containing at least one cathode side and at least on anode side and subjecting the heavy oil feedstream to a voltage in the range of about 4V to about 500V and a current density of about 10 mA/cm$^2$ to about 1000 mA/cm$^2$, thereby reducing at least a portion of the sulfur-containing molecules to hydrogen sulfide and resulting in a sulfur-lean heavy oil feedstream and hydrogen sulfide;

c) separating said hydrogen sulfide from said sulfur-lean heavy oil feedstream in a gas/liquid separation zone;

d) passing at least a portion of said hydrogen sulfide to a hydrogen sulfide oxidation zone containing a aqueous solution of an oxidized metal salt wherein the metal cation in the aqueous solution has an oxidation potential high enough to oxidize hydrogen sulfide to produce elemental sulfur, hydrogen ions and reduced metal ions;

e) separating and recovering the elemental sulfur;

f) passing said aqueous solution of hydrogen ions and reduced metal ions to the anode side of said electrochemical cell, wherein at least a portion of the reduced metal salts are reoxidized and at least a portion of the hydrogen ions migrate to the cathode side of said electrochemical cell to form hydrogen gas; and g) passing at least a portion of the oxidized metal salts back to the hydrogen sulfide oxidation zone.

In a preferred embodiment, at least about a 10 wt. % fraction of the heavy oil feedstream boils at a temperature of at least about 1050° F. (565° C.).

In another preferred embodiment, the hydrogen source is selected from water and hydrogen gas.

In another preferred embodiment the heavy oil feedstream is a bitumen.

DETAILED DESCRIPTION OF THE INVENTION

Figure 1:
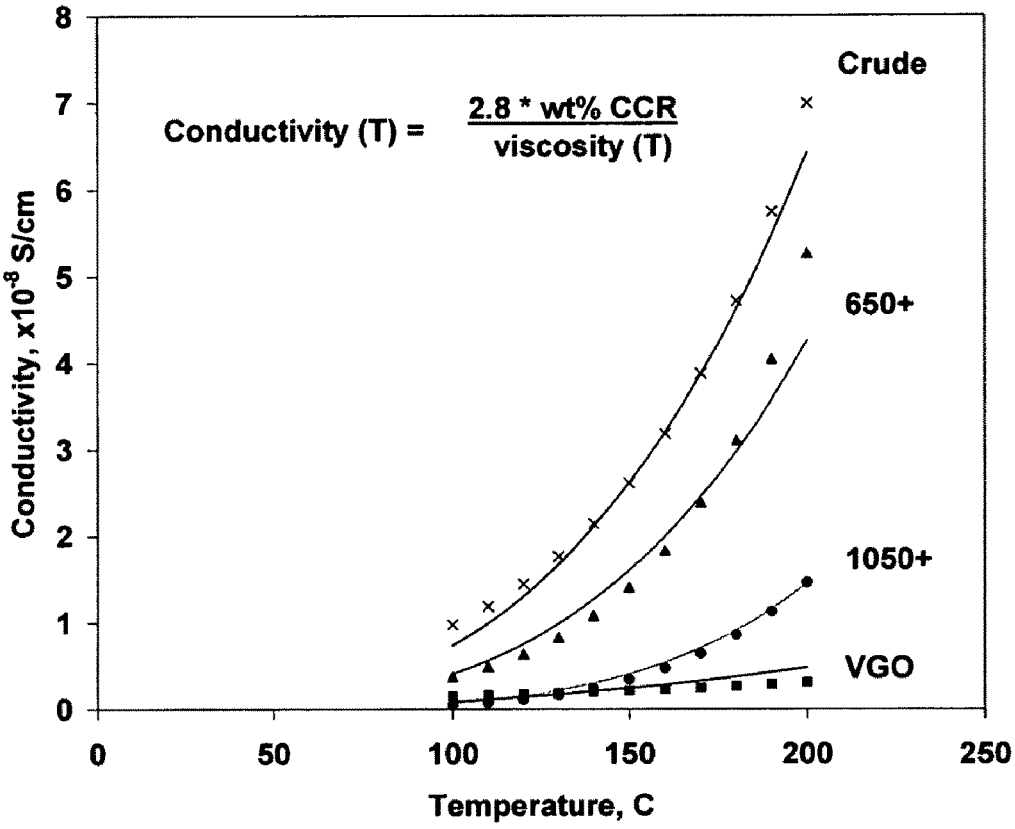
FIG. 1 hereof is a plot of conductivity versus temperature for various distillation cuts of a petroleum crude.

The process of the present invention is preferably practiced on sulfur-containing heavy oil feedstreams. In a preferred embodiment of the present invention, the heavy oil feedstreams contains at least about 10 wt. % of material boiling in excess of about 1050° F. (565° C.) at atmospheric pressure (defined as 0 psig), more preferably at least about 25 wt. % of material boiling above about 1050° F. (565° C.) at atmospheric pressure. Unless otherwise noted, all boiling temperatures herein are designated at atmospheric pressure (defined as 0 psig). Non-limiting examples of such feedstreams include whole, topped or froth-treated bitumens, heavy oils, whole or topped crude oils and residua. These include crude oils obtained from any area of the world, as well as heavy gas oils, shale oils, tar sands or syncrude derived from tar sands, coal oils, and asphaltenes. Additionally, both atmospheric residuum, boiling above about 650° F. (343° C.) and vacuum residuum, boiling above about 1050° F. (565° C.) can be treated in accordance with the present invention. The preferred feedstream to be treated in accordance with the present invention is bitumen. Bitumen is generally defined as a mixture of organic liquids that are highly viscous, black, sticky and composed primarily of highly condensed polycyclic aromatic hydrocarbons. Bitumen is obtained from extraction from oil shales and tar sands. Such heavy feedstreams contain an appreciable amount of so-called "hard" sulfur such as dibenzothiophenes (DBTs) that are very difficult to remove by conventional means.

These heavy feedstreams are sometimes desulfurized with use of sodium, as previously mentioned. In the sodium upgrading of bitumen, elemental sodium acts as a chemical reductant, each sodium atom transferring a single electron to molecules in the bitumen thereby initiating free radical desulfurization chemistry. In the electrochemical process of the present invention, reduction, or the generation of free radicals by transfer of electrons, is accomplished by use of an electrode polarized to the reducing potential of the target sulfur-containing molecules. The primary of advantage of this invention is that the sulfur is released from the heavy oil as hydrogen sulfide, in contrast to being released as sodium sulfide when sodium is used. Regeneration of elemental sodium from sodium sulfide is currently the critical technological limitation of the sodium process. The hydrogen sulfide produced by the practice of the present invention can be converted to sulfur in a Claus plant. The Claus process is well known in the art and is a gas desulfurizing process for recovering elemental sulfur from gaseous hydrogen sulfide. Typically gaseous streams containing at least about 25% hydrogen sulfide are suitable for a Claus plant. The Claus process is a two step process, thermal and catalytic. In the thermal step, hydrogen sulfide-laden gas reacts in a substoichiometric combustion at temperatures above about 1562° F. (850° C.) such that elemental sulfur precipitates in a downstream process gas cooler. The Claus reaction continues in a catalytic step with activated alumina or titanium dioxide, and serves to boost the sulfur yield. Further, the resulting sulfur-lean heavy oil product stream, or bitumen, is similar to that produced by the sodium process. The number of electrons required to initiate the radical chemistry in the process of the present invention will be roughly equivalent to the number required to regenerate sodium in the sodium treating process.

The process of the present invention does not require the addition of an electrolyte to the heavy oil feedstream, but rather, relies on the intrinsic conductivity of the heavy oil feedstream at elevated temperatures. It will be understood that the term "heavy oil" as used herein includes both bitumen and heavy oil petroleum feedstreams, such as crude oils, atmospheric resids, and vacuum resids. This process is preferably utilized to upgrade bitumens and/or crude oils that have an API gravity less than 15. The inventors hereof have undertaken studies to determine the electrochemical conductivity of crudes and residues (which includes bitumen and heavy oils) at temperatures up to about 572° F. (300° C.) and have demonstrated an exponential increase in electrical conductivity with temperature as illustrated in FIG. 1 hereof. It is believed that the electrical conductivity in crudes and residues is primarily carried by electron-hopping in the π-orbitals of aromatic and heterocyclic molecules. Experimental support for this is illustrated by the simple equation, shown in FIG. 1 hereof, that can be used to calculate the conductivity of various cuts of a crude using only its temperature dependent viscosity and its Conradson carbon (Concarbon) content. The molecules that contribute to Concarbon are primarily the large multi-ring aromatic and heterocyclic components.

A 4 mA/cm$^2$ electrical current density at 662° F. (350° C.) with an applied voltage of 150 volts and a cathode-to-anode gap of 1 mm was measured for an American crude oil. Though this is lower than would be utilized in preferred commercial embodiments of the present invention, the linear velocity for this measurement was lower than the preferred velocity ranges by about three orders of magnitude: 0.1 cm/s vs. 100 cm/s. Using a 0.8 exponent for the impact of increased flow velocity on current density at an electrode, it is estimated that the current density would increase to about 159 mA/cm2 at a linear velocity of about 100 cm/s. This suggests that more commercially attractive current densities achieved at higher applied voltages. Narrower gap electrode designs or fluidized bed electrode systems could also be used to lower the required applied voltage.

Figure 3:
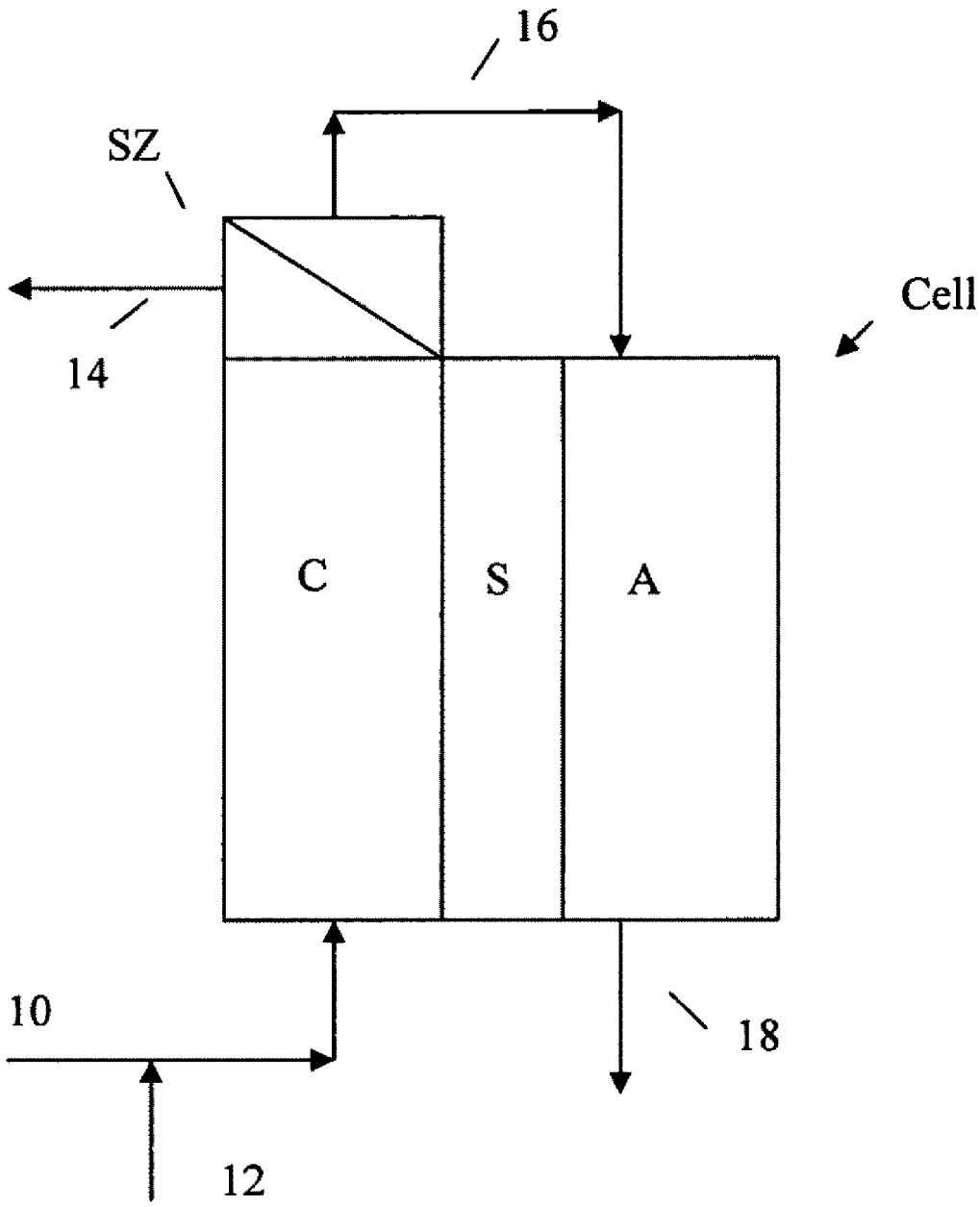
FIG. 3 is a simplified schematic of one embodiment of the present invention wherein a sulfur-containing heavy petroleum feedstream is passed through the cathode side of an electrochemical cell and the resulting hydrogen sulfide produced on the cathode side of an electrochemical cell is passed to the anode side wherein it is transformed into sulfur and hydrogen ions.

Two preferred embodiments are presented in this application. The first is represented in FIG. 3 hereof and the other in FIG. 4 hereof. In FIG. 3, the heavy oil feedstream to be treated is introduced, via line 10, to the cathodic side of a desulfurization electrochemical cell [Cell]. A source of hydrogen ions, preferably selected from water and hydrogen, is mixed into the heavy oil feedstream to be treated via line 12. An effective amount of hydrogen is used in all embodiments of the present invention. By "effective amount of hydrogen" we mean at least a stoichiometric amount based on the total amount of sulfur in the feedstream. Preferred is to use from about a stoichiometric amount to two times the stoichiometric amount of elemental hydrogen, $H_2$, to sulfur, S, in the feed. Total pressure will be in the range of about 10 to about 2000 psig, preferably from about 50 to about 1000 psig, more preferably from about 200 to about 500 psig. An effective amount of hydrogen via a hydrogen source is mixed with the heavy oil via line 12. This electrochemical cell is preferably comprised of parallel thin steel sheets mounted vertically within a standard pressure vessel shell. The gap between electrode surfaces will preferably be about 1 to about 50 mm, more preferably from about 1 to about 25 mm, and the linear velocity will be in the range of about 10 to about 500 cm/s, more preferably in the range of about 50 to about 200 cm/s. Electrical contacts are only made to the outer sheets. In an embodiment, the electrode stack is polarized with about 4 to 500 volts, more preferably about 100 to 200 volts, and a resulting current density of about 10 to 1000 mA/cm$^2$, more preferably a current density about 100 to about 500 mA/cm$^2$. Other commercial cell designs, such as a fluidized bed electrode can also be used in the practice of the present invention. As the heavy oil passes through the cathode side C of the electrochemical cell the organically bonded sulfur are reduced, and the sulfur is released as $H_2S$. Upon leaving the cathodic side the product stream is passed through a separation zone SZ wherein the hydrogen sulfide is separated from the treated heavy oil stream. The treated heavy oil feedstream is collected via line 14 and at least a portion of the separated hydrogen sulfide stream is passed, via line 16, directly to the anode side A of the same desulfurization electrochemical cell wherein it is oxidized to elemental sulfur and ionic hydrogen. The resulting elemental sulfur is collected via line 18 and ionic hydrogen migrates through the ion conducting membrane S and is consumed in the cathodic compartment during desulfurization.

Figure 4:
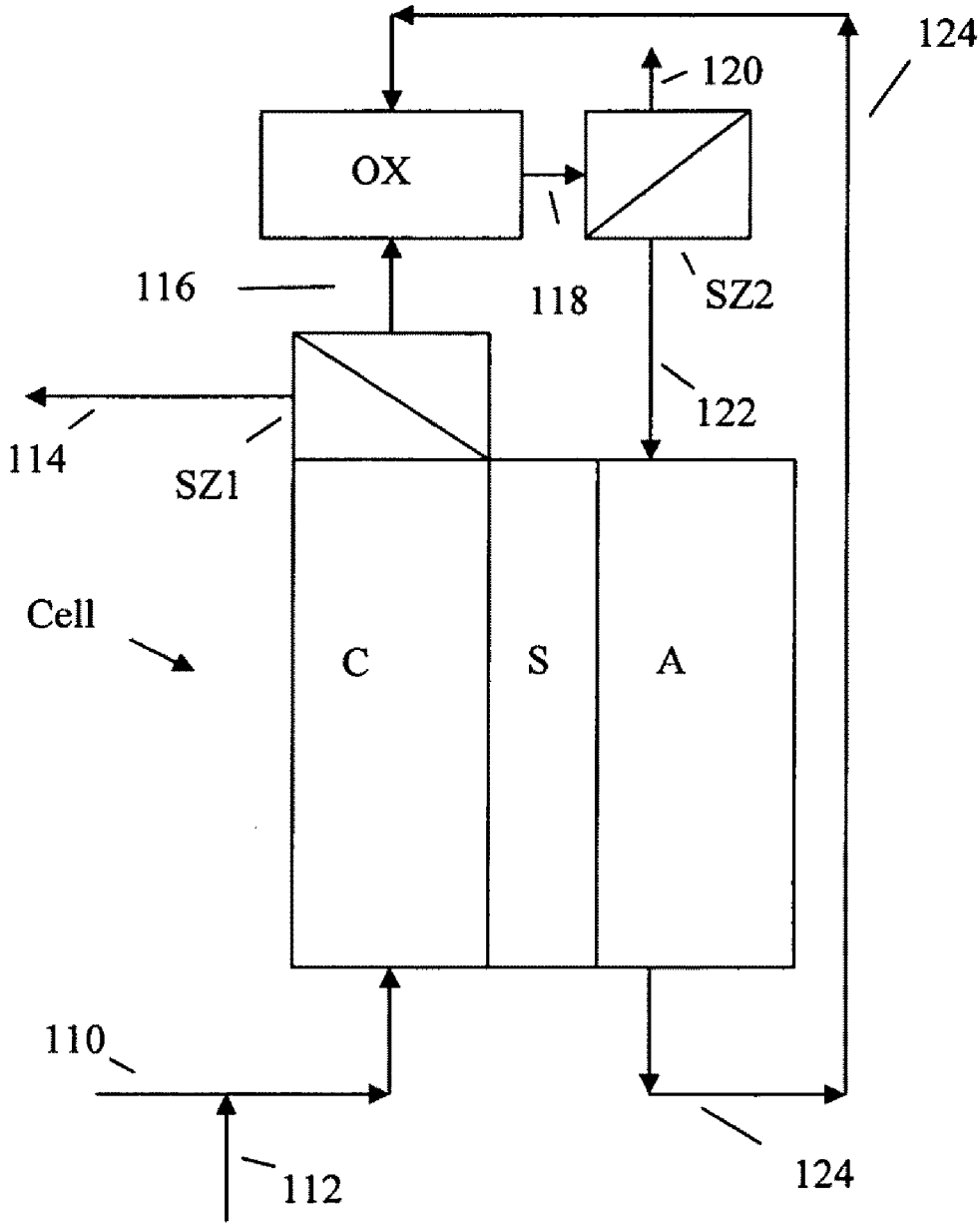
FIG. 4 is a simplified schematic of another embodiment of the present invention wherein the hydrogen sulfide produced in the cathode side of the electrochemical cell is passed to an oxidation zone containing an aqueous solution of a salt of an oxidized metal. The result is elemental sulfur, hydrogen ions and reduced metal ions. The hydrogen ions and metal ions are then passed to the anode side of the electrochemical cell wherein the hydrogen ions migrate to the cathode side and the reduced metal ions are oxidized to their original state.

FIG. 4 hereof represents an alternative embodiment wherein the hydrogen sulfide generated is first reacted with an aqueous solution of an oxidized metal salt in a hydrogen sulfide oxidation zone wherein the metal cation of the salt has a redox potential high enough to oxidize hydrogen sulfide to sulfur and hydrogen ions. The reduced metal salt and hydrogen ions are sent to the anodic side of said cell wherein the reduced metal salt is re-oxidized to its original state and the hydrogen ions migrate to the cathode side of the said cell. The re-oxidized metal salt is sent to the hydrogen sulfide oxidation zone. In this embodiment as illustrated in FIG. 4, the heavy oil is fed, via line 110, along with an effective amount of hydrogen from a hydrogen source via line 112, to the cathode side C of an electrochemical cell [Cell] where the organically bound sulfur is released as hydrogen sulfide. Upon leaving the cathodic side the product stream is passed through first separation zone SZ1 wherein the hydrogen sulfide is separated from the treated heavy oil stream. The treated heavy oil feedstream is collected via line 114 and at least a portion of the separated hydrogen sulfide stream is passed, via line 116, to the hydrogen sulfide oxidation zone OX where it is contacted with a aqueous solution of a salt of an oxidized metal, which metal has a standard oxidation potential greater than that for converting hydrogen sulfide to elemental sulfur and hydrogen ions. Non-limiting examples of metal ions of the metal salts that can be used in the practice of the present invention include $Fe^{+3}$, $Cu^{+2}$, $Ru^{+3}$, $[PtCl_6]^{-2}$, $[IrCl_6]^{-2}$, $[PdCl_6]^{-2}$, $Au^{+3}$, $Mn^{+3}$, and $Ce^{+4}$. Non-limiting examples of counter ions that can be used for the metal salts of this aqueous oxidation solution include $Cl^-$ and $SO_4^{-2}$. While the hydrogen sulfide oxidation zone can be operated in a variety of ways, it is preferred that it be operated at a temperature of about 77° F. to about 257° F. (25° C. to 125° C.) and at substantially atmospheric pressure.

The resulting product stream which is comprised of elemental sulfur, hydrogen ions, and reduced metal ions is passed via line 118 from the hydrogen sulfide oxidation zone OX to second separation zone SZ2 wherein the sulfur is removed via line 120 and the hydrogen ions and reduced metal ions are passed via line 122 to the anode side A of said electrochemical cell wherein the reduced metal ions are re-oxidized to their original state and the hydrogen ions migrate to the cathodic side through ion conducting membrane S to produce molecular hydrogen. Preferably, at least a portion of the re-oxidized metal ions are sent back to the hydrogen sulfide oxidation zone OX via line 124. Thus, the cathodic side of an electrochemical cell is used for electrodesulfurization while the anodic side is used for metal ion re-oxidation. $H_2S$ oxidation to sulfur is achieved chemically (or directly) in the oxidation zone OX by the re-oxidized metal ions.

The present invention will be better understood with reference to the following examples that are presented herein for illustrative purposes only and are not to be taken as being limiting in any manner.

For the following examples, a 300-cc autoclave (Parr Instruments, Moline, Ill.) was modified to allow two insulating glands (Conax, Buffalo, N.Y.) to feed through the autoclave head. Two cylindrical stainless steel (316) mesh electrodes were connected to the Conax glands, where a power supply (GW Laboratory DC Power Supply, Model GPR-1810HD) was connected to the other end. The autoclave body was fitted with a glass insert, a thermal-couple and a stirring rod. The autoclave was charged with the desired gas under pressure and run either in a batch mode or a flow-through mode.

COMPARATIVE EXAMPLE

Electrochemical Treatment of DBT Under $N_2$ in Dimethyl Sulfoxide Solvent With Tetrabutylammonium Hexafluorophosphate Electrolyte To the glass insert was added 1.0 g of dibenzothiophene (DBT), 3.87 g tetrabutylammonium hexafluorophosphate ($TBAPF_6$), and 100 milliliter ("ml") anhydrous dimethyl sulfoxide (DMSO, Aldrich). After the content was dissolved, the glass insert was loaded into the autoclave body, the autoclave head assembled and pressure tested. The autoclave was charged with 70 psig of $N_2$ and heated to 212° F. (100° C.) with stirring (300 rpm). A voltage of 5 Volts was applied and the current was 0.8 Amp. The current gradually decreased with time and after two hours, the run was stopped. The autoclave was opened and the content acidified with 10% HCl (50 ml). The acidified solution was then diluted with 100 ml of de-ionized ("DI") water, extracted with ether (50 ml×3). The ether layer was separated and dried over anhydrous $Na_2SO_4$, and ether was allowed to evaporate under a stream of $N_2$. The isolated dry products were analyzed by GC-MS. A conversion of 12% was found for DBT and the products are as the following.

[1]

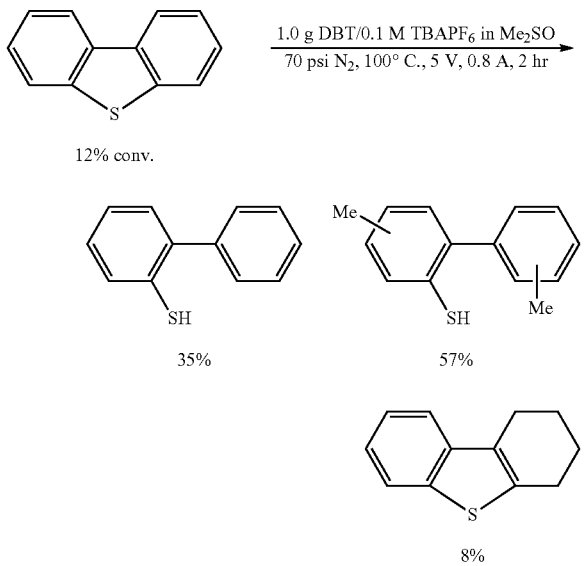

This example shows that the electrochemical reduction of DBT under $N_2$ resulted in: 12% DBT conversion after 2 h at 212° F. GC-MS revealed that the products consisted of 35% 2-phenyl benzenethiol, 8% tetrahydro-DBT, and 57% of a species with a mass of 214. The assignment of this peak as 2-phenyl benzenethiol was done by comparing with an authentic sample. The mass 214 species was tentatively assigned as 2-phenyl benzenethiol with two methyl groups added. Addition of methyl groups to DBT indicates that decomposition of solvent DMSO occurred since it is the only source of methyl groups in this system. No desulfurization product biphenyl was observed in this run.

EXAMPLE 1

Electrochemical Treatment of DBT Under $H_2$ in Dimethyl Sulfoxide Solvent With Tetrabutylammonium Hexafluorophosphate Electrolyte To the glass insert was added 0.5 g DBT, 3.87 g tetrabutylammonium hexafluorophosphate ($TBAPF_6$), and 100 ml anhydrous dimethyl sulfoxide (DMSO, Aldrich). After the content was dissolved, the glass insert was loaded into the autoclave body, the autoclave head assembled and pressure tested. The autoclave was charged with 300 psig of $H_2$ and heated to about 257° F. (125° C.) with stirring at about 300 rpm. A voltage of 4.5 Volts was applied and the current was 1.0 Amp. The current gradually decreased with time and after three and half (3.5) hours, the run was stopped. The autoclave was opened and the content acidified with 10% HCl (50 ml). The acidified solution was then diluted with 100 ml of DI water, extracted with ether (50 ml×3). The ether layer was separated and dried over anhydrous $Na_2SO_4$, and ether was allowed to evaporate under a stream of $N_2$. The isolated dry products were analyzed by GC-MS. A conversion of 16.5% was found for DBT and the products are as the following.

[2]

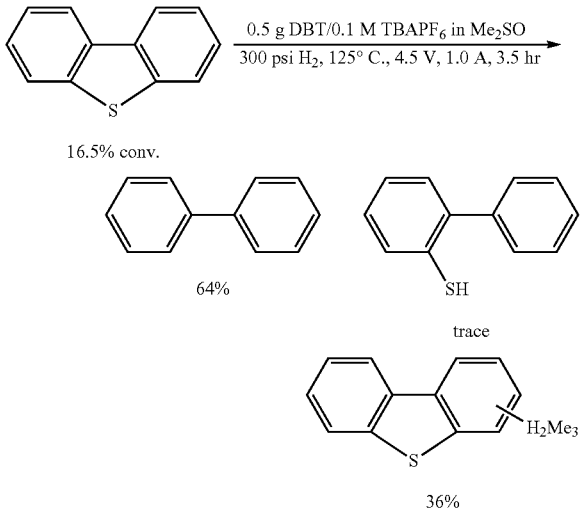

EXAMPLE 2

Electrochemical Treatment of DEDBT Under $H_2$ in Dimethyl Sulfoxide Solvent With Tetrabutylammonium Hexafluorophosphate Electrolyte To the glass insert was added 1.0 g 4,6-diethyl dibenzothiophene (DEDBT), 3.87 g tetrabutylammonium hexafluorophosphate ($TBAPF_6$), and 100-mL anhydrous dimethyl sulfoxide (DMSO, Aldrich). After the content was dissolved, the glass insert was loaded into the autoclave body, the autoclave head assembled and pressure tested. The autoclave was charged with 200 psig of $H_2$ and heated to about 212° F. with stirring (300 rpm). A voltage of 7 Volts was applied and the current was 1.0 Amp. The current gradually decreased with time and after two and half (2.5) hours, the run was stopped. The autoclave was opened and the content acidified with 10% HCl (50 ml). The acidified solution was then diluted with 100 ml of DI water, extracted with ether (50 ml×3). The ether layer was separated and dried over anhydrous $Na_2SO_4$, and ether was allowed to evaporate under a stream of $N_2$. The isolated dry products were analyzed by GC-MS. A conversion of 16% was found for DEDBT and the products are as the following.

[3]

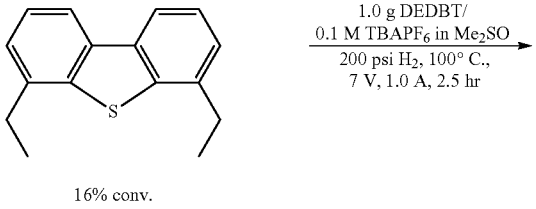

-continued

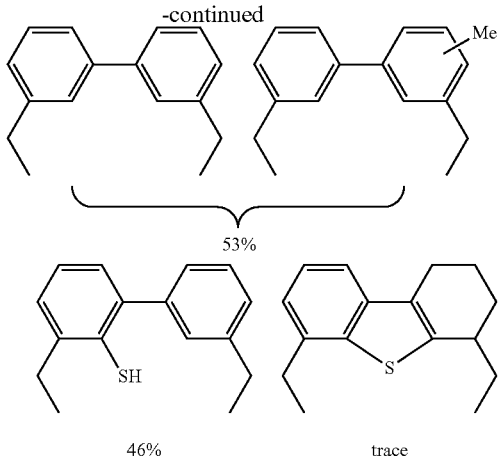

Similarly, desulfurization was also observed for sterically hindered Diethyl Dibenzothiophene (DEDBT) under $H_2$. The conversion was ca. 16% and the products contained 53% desulfurized compounds, 46% dihydro-DEDBT and a trace amount of tetrahydro-DEDBT. Solvent decomposition also occurs in this case. Although electrochemical desulfurization of DBT and hindered DBT has been achieved under $H_2$ in the 212° F. to 257° F. (100° to 125° C.) temperature range, the conversion is still quite low.

EXAMPLE 3

Figure 2:
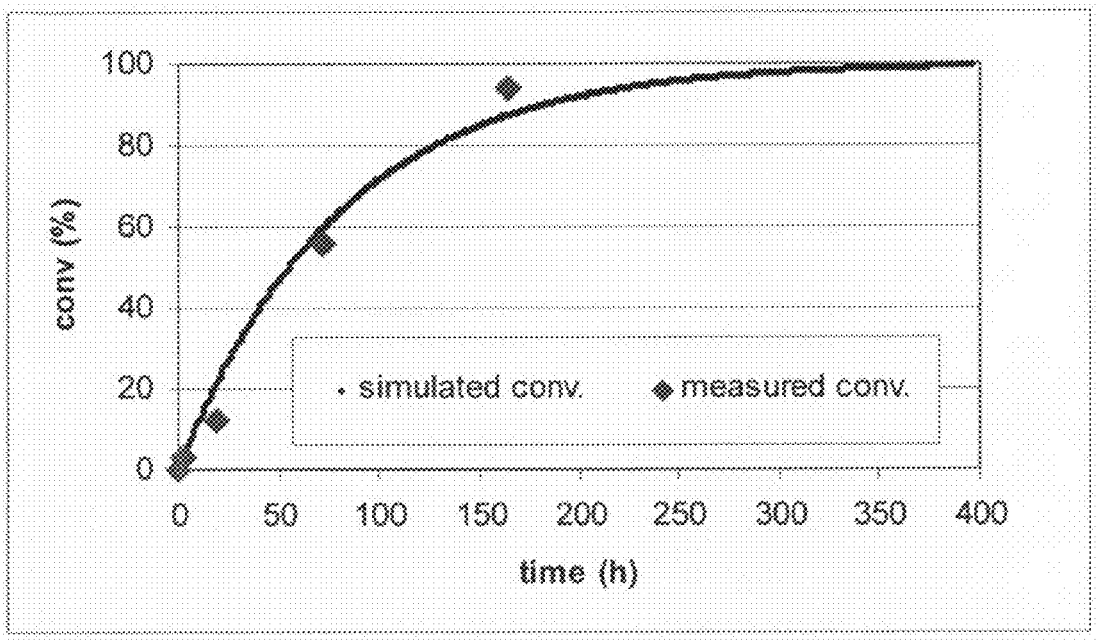
FIG. 2 hereof is a plot conversion of dibenzothiophene versus time for Example 3 hereof. This figure shows the overall degree of desulfurization appears to follow first order kinetics.

Room Temperature Electrochemical Reduction of Dibenzothiolphene (DBT) in DMSO Under Hydrogen As a proof of concept, it is critical to demonstrate that high conversion and high degree of desulfurization can be achieved. In this example, it was discovered that, at room temperature, the DMSO/$Bu_4NPF_6$ system allows the electrochemical reduction of DBT to be run for an extended period of time. Thermal degradation of the solvent/electrolyte is minimal at room temperature. Conversion of DBT and product distribution is listed in Table 1. Each row in the table represents a separate experiment run under identical conditions except for the length of electrolysis (0.5 g DBT, 4.0 g $Bu_4NPF_6$, 100 ml DMSO, 300 psig $H_2$, 4.5 V cell voltage, 77° F. (25° C.), acidic work-up). The electrolysis is clean under these conditions; and the products were isolated following the acidic work-up procedures and analyzed by GC-MS. The assignment for DBT-$H_2Me_3$ is tentative; assignments for other products are of high confidence, either by comparing with authentic samples or by good-quality match to the standard in the mass spectrum library. At short run time (3 h and 17 h), the products are 100% desulfurized. As the conversion goes up with increasing run time, small amounts of 2-phenyl benzenethiol and methylated DBT were observed. A small amount of heavy product, tetraphenyl, was also found at long run length (72 h and 163.5 h), which was probably formed from secondary electrochemical reactions. A conversion of 94% was achieved in a week, with the desulfurized products accounting for ~98% of the products. The overall degree of desulfurization is >90%. The conversion appears to follow first-order kinetics, with a simulated rate constant of $3.5\times10^{-6}$ $s^{-1}$ at room temperature (FIG. 2). These examples demonstrate that a high degree of desulfurization is achievable at room temperature, thus validating the concept of electrochemical desulfurization under hydrogen gas.

TABLE 1

| Time (h) | Conv. (%) | 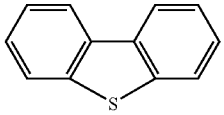 (%) | 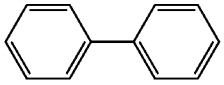 (%) | 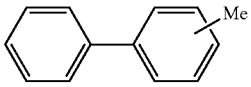 (%) | 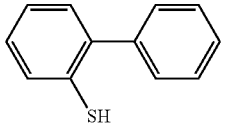 (%) |
|---|---|---|---|---|---|
| 3 | 2 | 100 | | | |
| 19 | 12 | 83 | | 17 | |
| 72 | 56 | 85 | | 7 | 2 |
| 163.5 | 94 | 81 | | 13 | 0.8 |

| Time (h) | 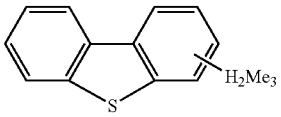 (%) | 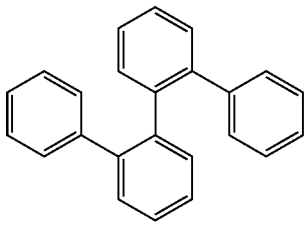 (%) |
|---|---|---|
| 3 | | |
| 19 | | |
| 72 | 3 | 3 |
| 163.5 | 1.4 | 3.4 |

What is claimed is:

1. A process for removing sulfur from heavy oil feedstreams containing sulfur-containing molecules, which process comprises:

a) heating and pressurizing said heavy oil feedstream to a temperature of about 400° F. (204° C.) to about 800° F. (426° C.) and a pressure of about 200 psig to about 700 psig;

b) passing said heated and pressurized heavy oil feedstream and an effective amount of a hydrogen source to the cathode side of a desulfurization electrochemical cell containing at least one cathode side and at least one anode side separated by an ion-permeable membrane and subjecting the heavy oil feedstream to a voltage in the range of about 4V to about 500V and a current density of about 10 mA/cm$^2$ to about 1000 mA/cm$^2$, thereby reducing at least a portion of the sulfur-containing molecules to hydrogen sulfide and resulting in a sulfur-lean heavy oil feedstream and hydrogen sulfide;

c) separating said hydrogen sulfide from said sulfur-lean heavy oil feedstream in a gas/liquid separation zone; and d) introducing at least a portion of said hydrogen sulfide into the anode side of said desulfurization electrochemical cell wherein it is oxidized to produce elemental sulfur and hydrogen ions, and at least a portion of the hydrogen ions migrate to the cathode side of said desulfurization electrochemical cell.

2. The process of claim 1 wherein the hydrogen source is selected from water and hydrogen.

3. The process of claim 2 wherein the hydrogen source is hydrogen.

4. The process of claim 1 wherein at least about a 10 wt. % fraction of said heavy oil feedstream boils at a temperature of at least about 1050° F. (565° C.).

5. The process of claim 4 wherein at least about a 25 wt. % fraction of said heavy oil feedstream boils at a temperature of at least about 1050° F. (565° C.).

6. The process of claim 4 wherein the feedstream is comprised of a bitumen.

7. The process of claim 6 wherein the electrochemical cell is operated at a voltage of about 100 volts to about 200 volts.

8. A process for removing sulfur from bitumen containing sulfur-containing molecules, which process comprises:

a) heating and pressurizing said bitumen to a temperature of about 400° F. (204° C.) to about 800° F. (426° C.) and a pressure of about 200 psig to about 700 psig;

b) passing said heated and pressurized bitumen and an effective amount of a hydrogen source to the cathode side of a desulfurization electrochemical cell containing at least one cathode side and at least one anode side separated by an ion-permeable membrane and subjecting the bitumen to a voltage in the range of about 4V to about 500V and a current density of about 10 mA/cm$^2$ to about 1000 mA/cm$^2$, thereby reducing at least a portion of the sulfur-containing molecules to hydrogen sulfide and resulting in a sulfur-lean bitumen and hydrogen sulfide;

c) separating said hydrogen sulfide from said sulfur-lean bitumen in a gas/liquid separation zone; and d) introducing at least a portion of said hydrogen sulfide into the anode side of said desulfurization electrochemical cell wherein it is oxidized to produce elemental sulfur and hydrogen ions, and at least a portion of the hydrogen ions migrate to the cathode side of said desulfurization electrochemical cell.

9. The process of claim 8 wherein the hydrogen source is selected from water and hydrogen.

10. The process of claim 9 wherein the hydrogen source is hydrogen.

11. The process of claim 10 wherein the electrochemical cell is operated at a voltage of about 100 volts to about 200 volts.

12. A process for removing sulfur from heavy oil feedstreams containing sulfur-containing molecules, which process comprises:

a) heating and pressurizing said heavy oil feedstream to a temperature of about 400° F. (204° C.) to about 800° F. (426° C.) and a pressure of about 200 psig to about 700 psig;

b) passing the heated and pressurized heavy oil feedstream and an effective amount of a hydrogen source to the cathode side of a desulfurization electrochemical cell containing at least one cathode side and at least on anode side and subjecting the heavy oil feedstream to a voltage in the range of about 4V to about 500V and a current density of about 10 $mA/cm^2$ to about 1000 $mA/cm^2$, thereby reducing at least a portion of the sulfur-containing molecules to hydrogen sulfide and resulting in a sulfur-lean heavy oil feedstream and hydrogen sulfide;

c) separating said hydrogen sulfide from said sulfur-lean heavy oil feedstream in a gas/liquid separation zone;

d) passing at least a portion of said hydrogen sulfide to a hydrogen sulfide oxidation zone containing a aqueous solution of an oxidized metal salt wherein the metal cation in the aqueous solution has an oxidation potential high enough to oxidize hydrogen sulfide to produce elemental sulfur, hydrogen ions and reduced metal ions;

e) separating and recovering the elemental sulfur;

f) passing said aqueous solution of hydrogen ions and reduced metal ions to the anode side of said electrochemical cell, wherein at least a portion of the reduced metal salts are reoxidized and at least a portion of the hydrogen ions migrate to the cathode side of said electrochemical cell to form hydrogen gas; and g) passing at least a portion of the oxidized metal salts back to the hydrogen sulfide oxidation zone.

13. The process of claim 12 wherein the hydrogen source is selected from water and hydrogen.

14. The process of claim 13 wherein the hydrogen source is hydrogen.

15. The process of claim 12 wherein at least about a 10 wt. % fraction of said heavy oil feedstream boils at a temperature of at least about 1050° F. (565° C.).

16. The process of claim 15 wherein at least about a 25 wt. % fraction of said heavy oil feedstream boils at a temperature of at least about 1050° F. (565° C.).

17. The process of claim 15 wherein the feedstream is comprised of a bitumen.

18. The process of claim 17 wherein the electrochemical cell is operated at a voltage of about 100 volts to about 200 volts.

19. The process of claim 12 wherein the metal ion of the metal salt is selected from the group consisting of $Fe^{+3}$, $Cu^{+2}$, $Ru^{+3}$, $[PtCl_6]^{-2}$, $[IrCl_6]^{-2}$, $[PdCl_6]^{-2}$, $Au^{+3}$, $Mn^{+3}$, and $Ce^{+4}$.

20. The process of claim 12 wherein the anion of the metal salt is selected from $Cl^-$ and $SO_4^{-2}$.

21. A process for removing sulfur from bitumen containing sulfur-containing molecules, which process comprises:

a) heating and pressurizing said bitumen to a temperature of about 400° F. (204° C.) to about 800° F. (426° C.) and a pressure of about 200 psig to about 700 psig;

b) passing the heated and pressurized bitumen and an effective amount of a hydrogen source to the cathode side of a desulfurization electrochemical cell containing at least one cathode side and at least one anode side and subjecting the bitumen to a voltage in the range of about 4V to about 500V and a current density of about 10 $mA/cm^2$ to about 1000 $mA/cm^2$, thereby reducing at least a portion of the sulfur-containing molecules to hydrogen sulfide and resulting in a sulfur-lean bitumen and hydrogen sulfide;

c) separating said hydrogen sulfide from said sulfur-lean bitumen in a gas/liquid separation zone;

d) passing at least a portion of said hydrogen sulfide to a hydrogen sulfide oxidation zone containing a aqueous solution of an oxidized metal salt wherein the metal cation in the aqueous solution has an oxidation potential high enough to oxidize hydrogen sulfide to produce elemental sulfur, hydrogen ions and reduced metal ions;

e) separating and recovering the elemental sulfur;

f) passing said aqueous solution of hydrogen ions and reduced metal ions to the anode side of said electrochemical cell, wherein at least a portion of the reduced metal salts are reoxidized and at least a portion of the hydrogen ions migrate to the cathode side of said electrochemical cell to form hydrogen gas; and g) passing at least a portion of the oxidized metal salts back to the hydrogen sulfide oxidation zone.

22. The process of claim 21 wherein the hydrogen source is selected from water and hydrogen.

23. The process of claim 22 wherein the hydrogen source is hydrogen.

24. The process of claim 21 wherein the metal ion of the metal salt is selected from the group consisting of $Fe^{+3}$, $Cu^{+2}$, $Ru^{+3}$, $[PtCl_6]^{-2}$, $[IrCl_6]^{-2}$, $[PdCl_6]^{-2}$, $Au^{+3}$, $Mn^{+3}$, and $Ce^{+4}$.

25. The process of claim 21 wherein the anion of the metal salt is selected from $Cl^-$ and $SO_4^{-2}$.

* * * * *